US005720488A

United States Patent [19]

Foffano et al.

[11] Patent Number: 5,720,488

[45] Date of Patent: Feb. 24, 1998

[54] IN-LINE SKATE

[75] Inventors: Massimo Foffano, Treviso; Peter Edauw, Camalo' Di Povegliano, both of Italy

[73] Assignee: Nordica, S.p.A., Italy

[21] Appl. No.: 499,558

[22] Filed: Jul. 7, 1995

[30] Foreign Application Priority Data

Nov. 9, 1993 [IT] Italy ..... TV93A0096
Nov. 9, 1993 [IT] Italy ..... TV93A0098

[51] Int. Cl.[6] ..... A63C 17/06

[52] U.S. Cl. ..... 280/11.22; 280/11.27

[58] Field of Search ..... 280/11.22, 11.27, 280/11.28, 11.19, 11.23

[56] References Cited

U.S. PATENT DOCUMENTS

| | | | |
|---|---|---|---|
| 4,058,324 | 11/1977 | Dallaire | 280/11.22 |
| 4,657,265 | 4/1987 | Ruth | 280/7.13 |
| 5,046,746 | 9/1991 | Gierveld | 280/11.22 |
| 5,303,940 | 4/1994 | Brandner | 280/11.22 |
| 5,366,232 | 11/1994 | Pozzobon et al. | 280/11.22 |
| 5,452,907 | 9/1995 | Meibock et al. | 280/11.22 |
| 5,580,070 | 12/1996 | Bekessy | 280/11.27 |

FOREIGN PATENT DOCUMENTS

| | | |
|---|---|---|
| 2566672 | 6/1984 | France . |
| 8701675 | 2/1989 | Netherlands . |

*Primary Examiner*—Brian L. Johnson
*Assistant Examiner*—Michael Mar
*Attorney, Agent, or Firm*—Welsh & Katz, Ltd.

[57] ABSTRACT

An in-line skate having a support for in-line wheels; the support is associated with the skate frame in order to be transversely adjustable. It is thus possible to vary the mutual position of the longitudinal axis of the wheels and of the longitudinal axis of the frame.

8 Claims, 6 Drawing Sheets

IN-LINE SKATE

BACKGROUND OF THE INVENTION

The present invention relates to an in-line skate.

Conventional in-line skates comprise a support for a shoe and rigid wings or tabs associated with the support and between which aligned wheels are pivoted. The use of these skates is increasingly specifically oriented towards speed skating, hockey, slalom, or long-distance skating such as marathons.

Specifically for hockey or slalom, the athlete changes skating direction by means of a short stroke with frequent lateral thrusts of the foot, which are transmitted directly to the skate. Quick increases in speed are also frequent and can be obtained by again exerting strong lateral thrusts at a high rate and with a short stroke.

The drawback that can be observed in these conventional skates is the difficulty in customizing the skate according to the extent of these thrusts, to the length of the stroke, and to the physical characteristics of the skater.

This customization also has the drawback that it requires different characteristics for engaging in long-distance speed competitions instead of hockey or slalom: in this case lateral thrusts are less frequent and the stroke is longer because the track does not require sudden direction changes and because the increase in speed does not have to compensate for the sharp braking performed during hockey or slalom.

U.S. Pat. No. 4,058,324 discloses a roller skate in which a support is associated below the shoe. The support is in turn associable with the wheel supporting frame, and there are means to allow a longitudinal movement of the support with respect to the frame, as well as means to allow the longitudinal movement of the intermediate wheel with respect to the outer wheel.

The support also has transverse slots which act seats for screws for locking the sole of the shoe.

This solution is specifically provided to allow change in the mutual axial alignment of the individual wheels with respect to the frame to which they are pivoted, and therefore it is not specifically suitable for solving the above mentioned drawbacks.

The solution is also structurally very complicated, with adjustments that require a long time and special tools.

In any case, the transmission of efforts from the shoe to the frame must occur by means of the screws that fix the sole to the support and by means of the screws that connect the support to the frame; on one hand this may allow displacements with respect to the selected adjustment, caused by the considerable stresses applied during the lateral movement of the skate when speed is being increased, with the consequent forming of possible plays, and on the other hand this provides incomplete and non-optimum transmission of efforts from the foot to the wheels.

Moreover, the cost of this solution is high.

SUMMARY OF THE INVENTION

The aim of the present invention is to eliminate the described technical problems and to solve the drawbacks described above in conventional types by providing an in-line skate that allows the user to customize the skate according to the specific sport of hockey, slalom, or long-distance speed skating, while maintaining an optimum transmission of effort from the foot to the wheels.

Within the scope of this aim, an important object is to provide a skate that allows the user to achieve these customizations rapidly and easily without requiring particular instruments or tools.

Another object is to provide a skate that has low manufacturing costs.

Another object is to provide a skate in which it is possible to rapidly and easily replace the wheels completely depending on whether slalom or speed skating is being practiced.

Another object is to provide a skate whose maneuverability characteristics can be modified by the user according to specific requirements such as the type of use or the skill level achieved.

Another important object is to provide a skate that is structurally simple, can be easily industrialized, and can be obtained with conventional machines and equipment.

Another object is to provide a skate that associates with the preceding characteristics that of being reliable and safe in use.

This aim, these objects, and others which will become apparent hereinafter are achieved by an in-line skate, characterized in that it comprises a frame associated with a support having a plurality of in-line wheels, means being provided for adjusting the position of said support with respect of said frame.

BRIEF DESCRIPTION OF THE DRAWINGS

Further characteristics and advantages of the invention will become apparent from the detailed description of some particular but not exclusive embodiments, illustrated only by way of non-limiting examples in the accompanying drawings, wherein.

DESCRIPTION OF THE PREFERRED EMBODIMENTS

Figure 1:
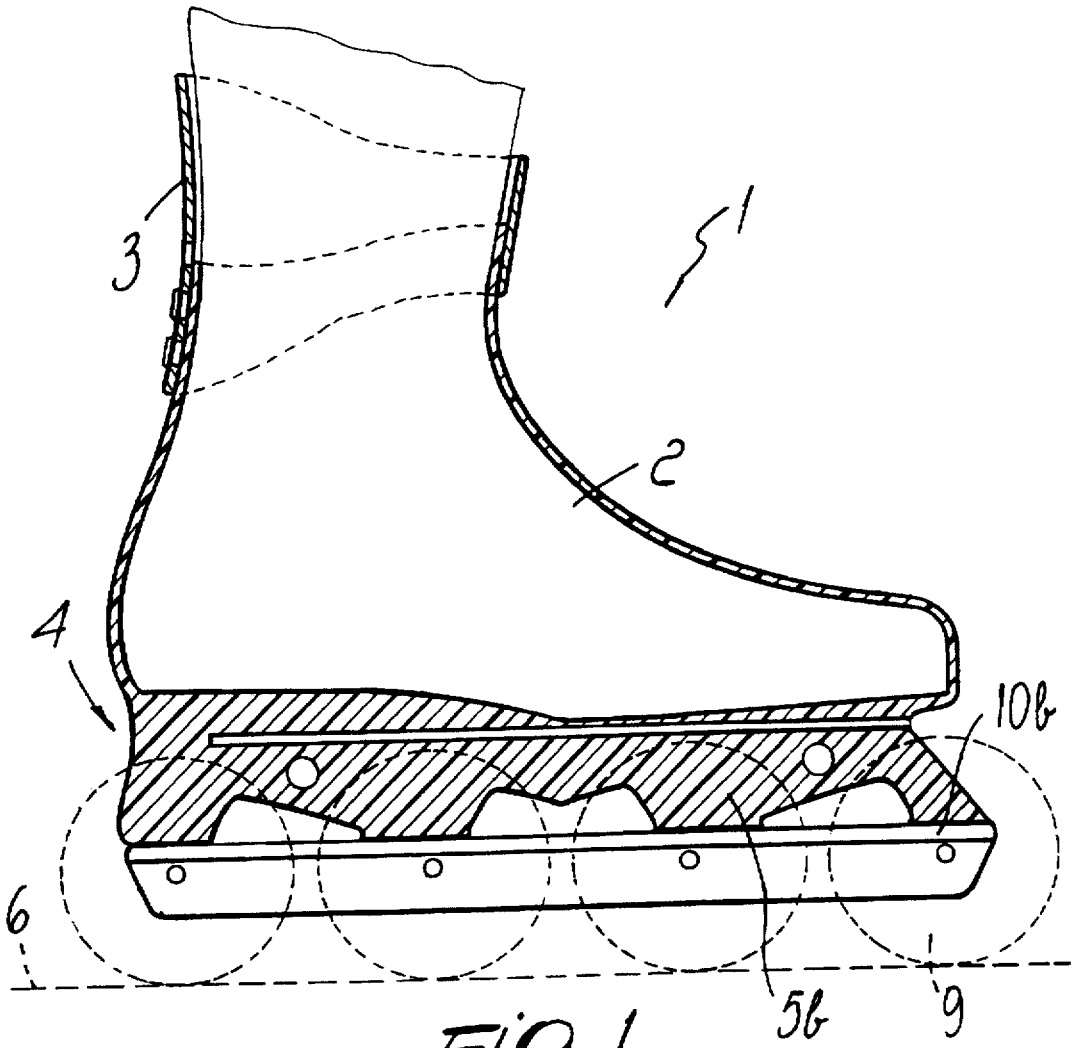
FIG. 1 is a partially sectional side view of the skate.
Figure 2:
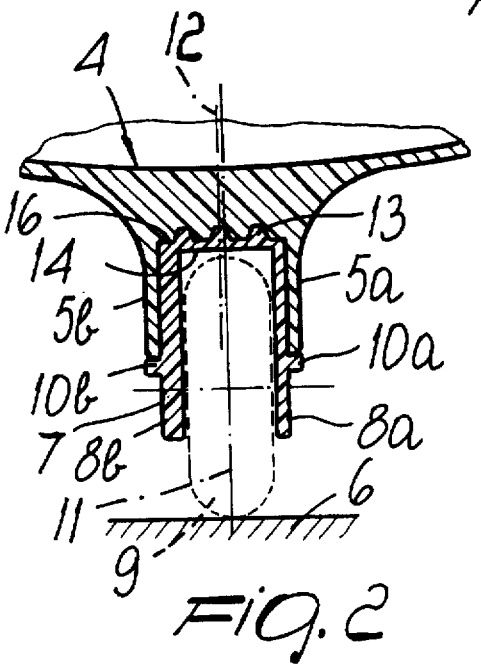
FIGS. 2 and 3 are sectional views, taken transversely to the frame, of the possible arrangement of the support.
Figure 3:
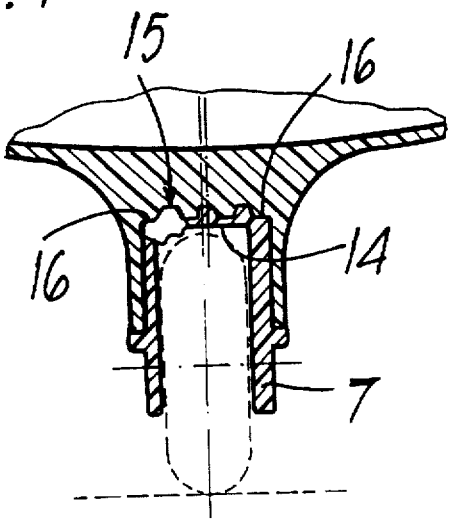

With reference to the above figures, the reference numeral 1 designates a skate which has at least one quarter 3 associated with a shell 2 and below which an essentially U-shaped frame 4 is associated and forms first wings 5*a* and 5*b* which are directed towards the ground 6.

The skate 1 comprises a support 7 which is also preferably essentially U-shaped and between the second wings 8*a* and 8*b* of which multiple wheels 9 are pivoted and thus mutually aligned.

The shape of the support 7 permits movable insertion between the first wings 5*a* and 5*b* of the frame 4; this insertion can occur equally along a direction that lies at right angles to the longitudinal axis of said frame 4 or parallel thereto.

Conveniently, the second wings 8*a* and 8*b* have one or more suitable pairs of raised portions 10*a* and 10*b* or, as an alternative, a single pair of raised portions, which, once the support has been inserted, abut against the free ends of the first wings 5*a* and 5*b* of the frame 4.

Another particularity of the support 7 is constituted by the fact that the second wings 8*a* and 8*b* have different thicknesses: this allows, when the support is removed and reinserted after rotating it through 180°, to vary the mutual position of the longitudinal median axis 11 of the wheels and of the longitudinal median axis 12 of the frame 4.

It is thus possible to change the mutual axial alignment of axes 11 and 12.

The skate also comprises guiding and centering means which are constituted by suitable ridges 13 which protrude from the first base 14 of the support 7 and arrange themselves at suitable complementary shaped guides 15 formed on the second base 16 of the frame 4.

It is thus possible to vary the position of the axes 11 and 12, so as to allow a different position of the shoe with respect to the axis that passes through the points where the wheels touch the ground.

Varying the distance between said wheel contact axis and the center of gravity of the user in fact entails advantages according to the sport being practiced: the smaller the distance between said axis that passes through the wheel contact points and the center of gravity of the body, the longer the stroke, considered as the step after the outward thrusting of the skate; accordingly, less frequent thrusts are required, but this entails a slower return of the leg at the end of the stroke to start the subsequent thrust.

Therefore, if it is possible to place the longitudinal median axis 11 of the wheels in a region that is closer to the longitudinal plane on which the center of gravity of the user's weight is projected, the skating action becomes more effective in the practice of long-distance speed skating, where long and constant strokes are required, with wide curves and with speeds that are practically constant or entail small accelerations.

Vice versa, the greater the distance between the center of gravity of the body and the wheel contact point, the shorter the stroke; accordingly, more frequent thrusts are required, but the return of the leg after the stroke to start the following thrusting step is much faster.

Therefore, by placing the wheels towards the outside of the frame one obtains quick direction changing, which is a characteristic that is particularly suitable for hockey or slalom, where rapid acceleration with short and frequent thrusts is also required.

The invention can also be used to correct the position of the center of gravity of the skater with respect to the wheel contact points for example if the skater suffers from a varus or valgoid condition.

Finally, it should be stressed that it is possible to arrange the wheels asymmetrically, for example towards the outside on the right skate and towards the inside on the left skate: this permits compensation for the position assumed by the skater in loop-shaped circuits used in speed contests, which is always tilted to the same side.

In this case the thrust is in fact almost always directed towards the inside of the circuit.

It has thus been observed that the invention has achieved the intended aim and objects, a skate having been provided in which it is possible to move the longitudinal median axis of the wheels laterally outward or inward with respect to the axis of the frame, thus allowing customization of the skate without modifying the transmission of efforts between the frame and the support and without limiting the mutual longitudinal movements of said frame and said support.

The described solution is also mechanically very simple and is formed of elements which can be easily and rapidly industrialized, allowing considerable cost containment.

Furthermore, the arrangement of the two axes can be changed rapidly and easily even by the user, without having to use specific tools. This also allows replacements, in a single operation, of all the wheels according to the specific sport.

The skate according to the invention is naturally susceptible of numerous modifications and variations, all of which are within the scope of the same inventive concept.

Figure 4:
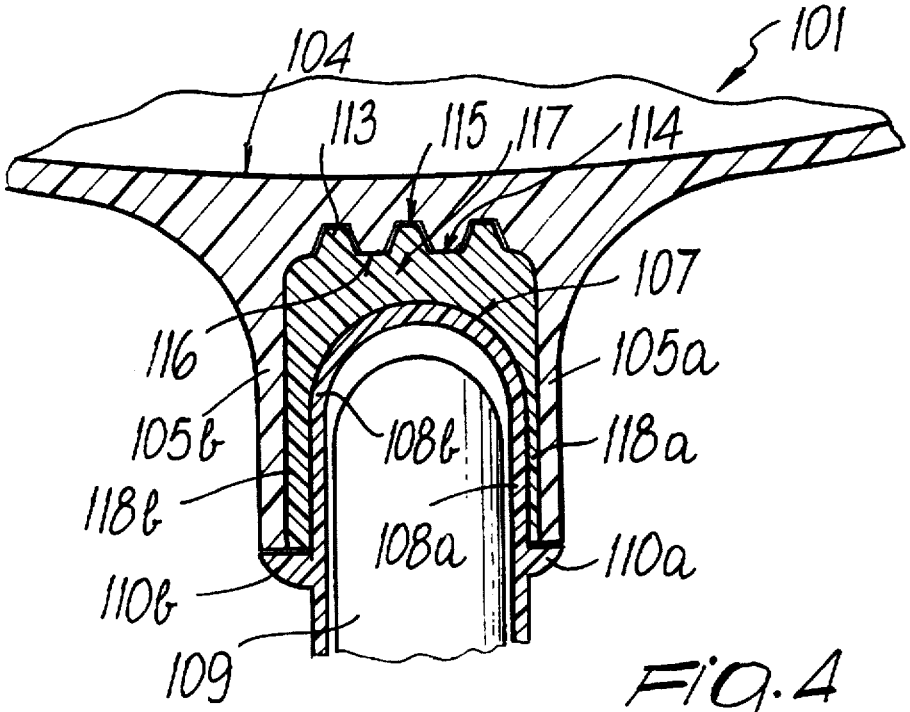
FIG. 4 is a view, similar to FIG. 2, of another embodiment.

Thus, for example, FIG. 4 illustrates a skate 101 in which there is a frame 104 which is essentially U-shaped so as to form first wings 105*a* and 105*b* directed towards the ground.

The skate 1 comprises a support 107 which is also preferably essentially U-shaped; multiple wheels 109 are pivoted between the second wings 108*a* and 108*b* of said support and are thus mutually aligned.

The second wings 108*a* and 108*b* have one or more suitable pairs of raised portions 110*a* and 110*b* or, as an alternative, a single pair of raised portions, which abut against the free ends of the first wings 105*a* and 105*b* of the frame 104 once the support has been inserted.

The skate also comprises an insert 117 which can be removably interposed between the frame 104 and the support 107; said insert has third wings 118*a* and 118*b* which can be interposed between the first wings 105*a* and 105*b* and the second wings 108*a* and 108*b*.

The third wings have different thicknesses, so as to allow, once the support 107 and the insert 117 have been extracted and then rotated through 180°, to vary the mutual position of the longitudinal median axis of the wheels and of the longitudinal median axis of the frame.

Again, there are guiding and centering means which are constituted by suitable ridges 113 which protrude from the first base 114 of the insert 117 and are located at suitable and complementary shaped guides 115 formed on the second base 116 of the frame 104.

Figure 5:
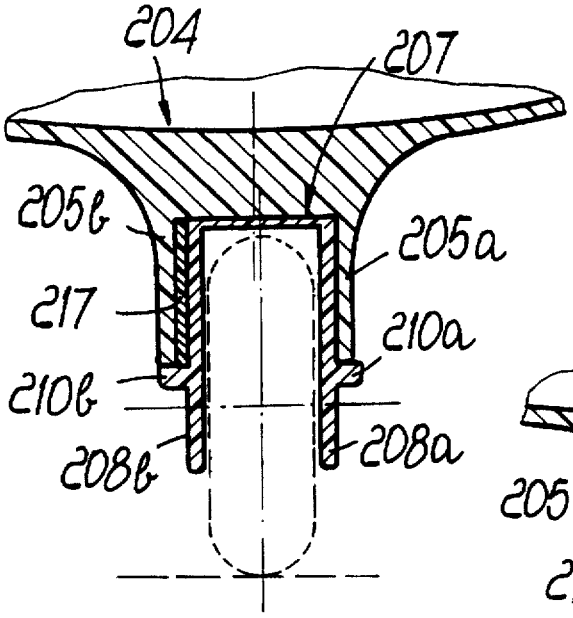
FIGS. 5 and 6 are views, similar to FIGS. 2 and 3, of another embodiment.
Figure 6:
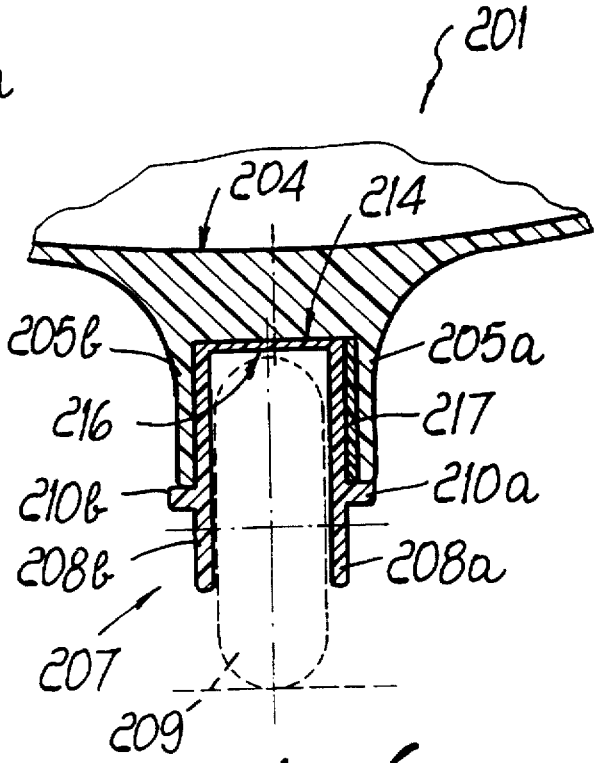

FIGS. 5 and 6 illustrate a further skate 201 in which there is a frame 204 which is essentially U-shaped so as to form first wings 205*a* and 205*b* directed towards the ground.

The skate 201 comprises a support 207 which is also preferably essentially U-shaped; multiple wheels 209 are pivoted between its second wings 208*a* and 208*b* and are thus mutually aligned.

The second wings 208*a* and 208*b* have one or more suitable pairs of raised portions 210*a* and 210*b* or, as an alternative, a single pair of raised portions, which abut against the free ends of the first wings 205*a* and 205*b* of the frame 204 once the support has been inserted.

At least one insert 217 can be removably interposed between at least one of the side walls of said support 207 and said frame 204, has the desired thickness, and is preferably made of rigid or semirigid material.

The first base 214 of the frame 204 is of course wider than the second base 216 of the support 207 to allow to introduce the insert.

Figure 8:
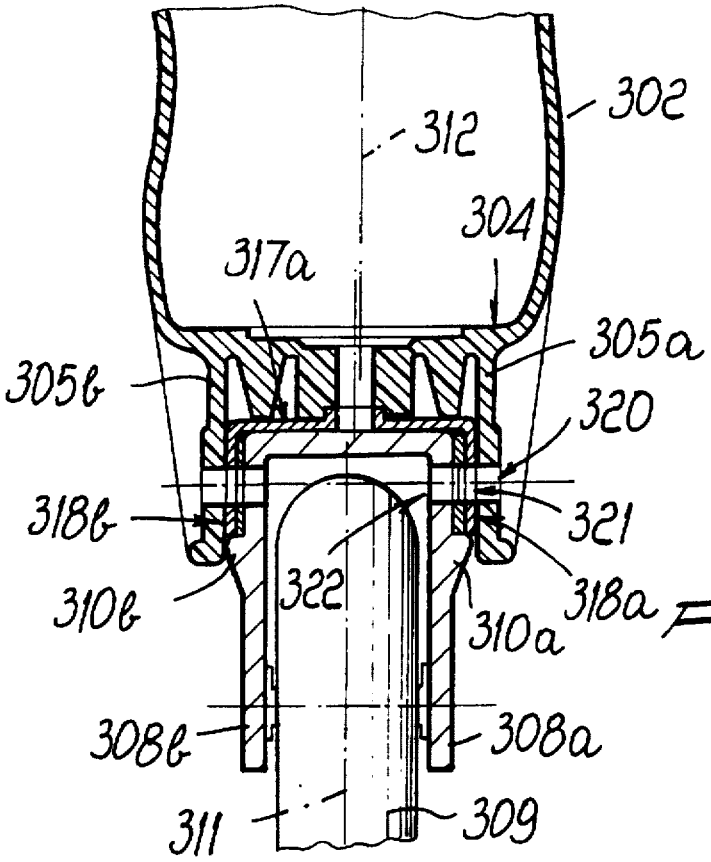
FIG. 8 is a view, similar to FIG. 2, of the embodiment of FIG. 7.
Figure 7:
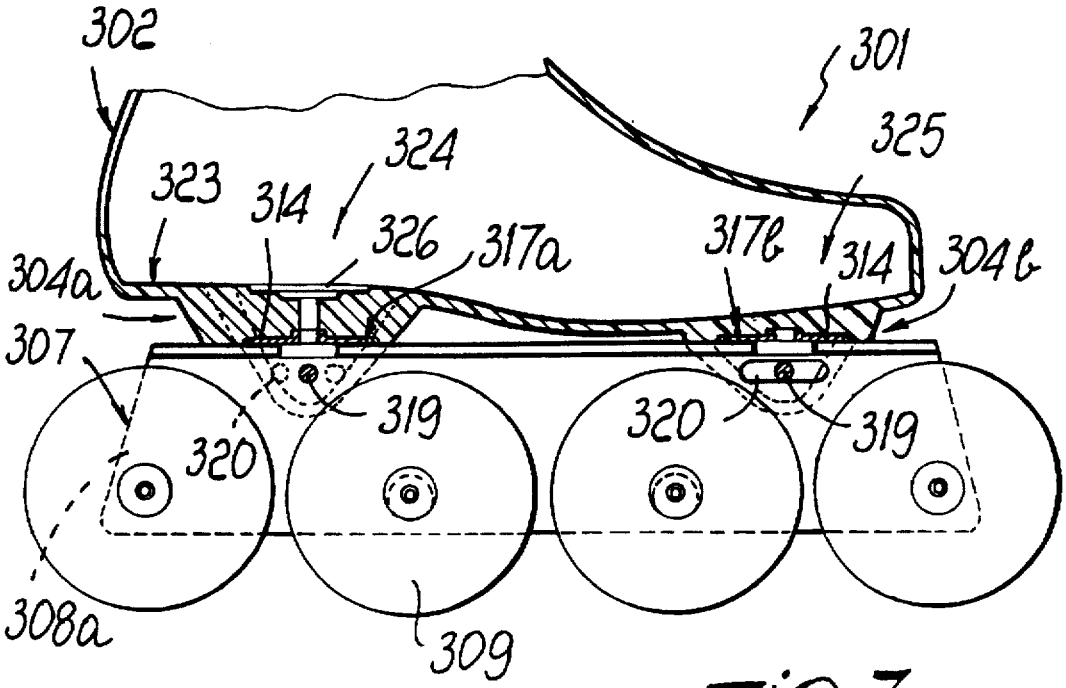
FIG. 7 is a view, similar to FIG. 1, of another embodiment.

FIGS. 7 and 8 illustrate a skate 301 in which below the sole 323 of the shell 302 there is a frame which is constituted by a first tab 304*a* and by a second tab 304*b* which are essentially U-shaped so as to form, for each tab, first wings 305*a* and 305*b* which are directed towards the ground and are respectively arranged in the heel region 324 and in the toe region 325.

The skate 301 comprises a support 307 which is also preferably essentially U-shaped and between the second wings 308*a* and 308*b* of which multiple wheels 309 are pivoted and thus mutually aligned.

The second wings 308*a* and 308*b* have one or more suitable pairs of raised portions 310*a* and 310*b* or, as an alternative, a single pair of raised portions; once the support has been inserted, said raised portions abut against the free ends of the third wings 318*a* and 318*b* which are present on a first insert 317*a* and on a second insert 317*b* which can be removably interposed between the first wing 304*a* and the support 307 and between the second tab 304*a* and the support 307 respectively.

Said third wings 318*a* and 318*b* can thus be interposed between the first wings 305*a* and 305*b* and part of the second wings 308*a* and 308*b* in the region above the raised portions 310*a* and 310*b*.

In this solution, the first, second, and third wings are mutually connected by means of a pair of suitable pins 319 which pass within respective first, second, and third holes or slots, designated by the reference numerals 320, 321, and 322, which have the same axis and are formed on said first, second, and third wings.

In this solution, too, the third wings can have different thickness so as to allow, once the pins 319 and thus the support 307 and the insert 317 have been removed and rotated through 180°, variation of the mutual position of the longitudinal median axis of the wheels and of the longitudinal median axis of the frame.

As an alternative, a spacer of the desired thickness can be interposed between one of the third wings 318*a* and 318*b* and the second wings 308*a* and 308*b*.

In this case, too, it is therefore possible to vary the position of the longitudinal median axis 311 of the wheels and the longitudinal median axis 312 of the shell 302, and the connection between the sole 323 and the inserts 317*a* and 317*b* occurs by means of a screw 326.

Figure 9:
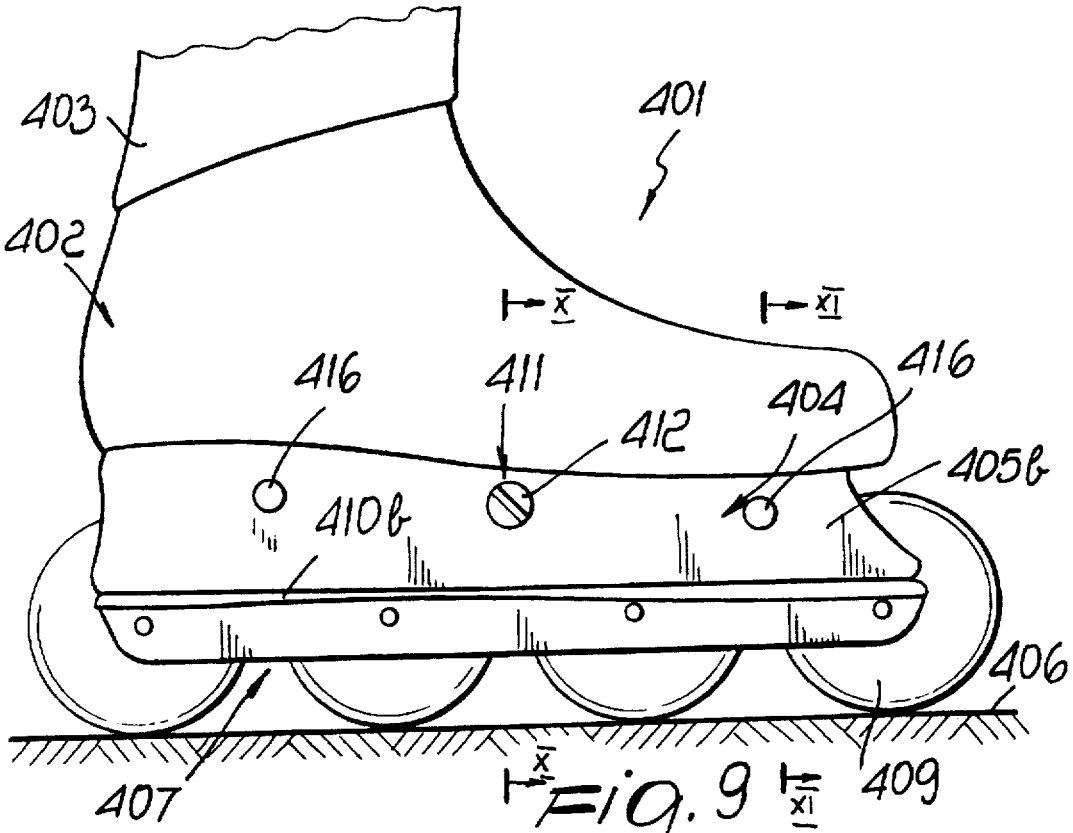
FIG. 9 is a side view of the skate, according to a further embodiment of the invention.
Figure 10:
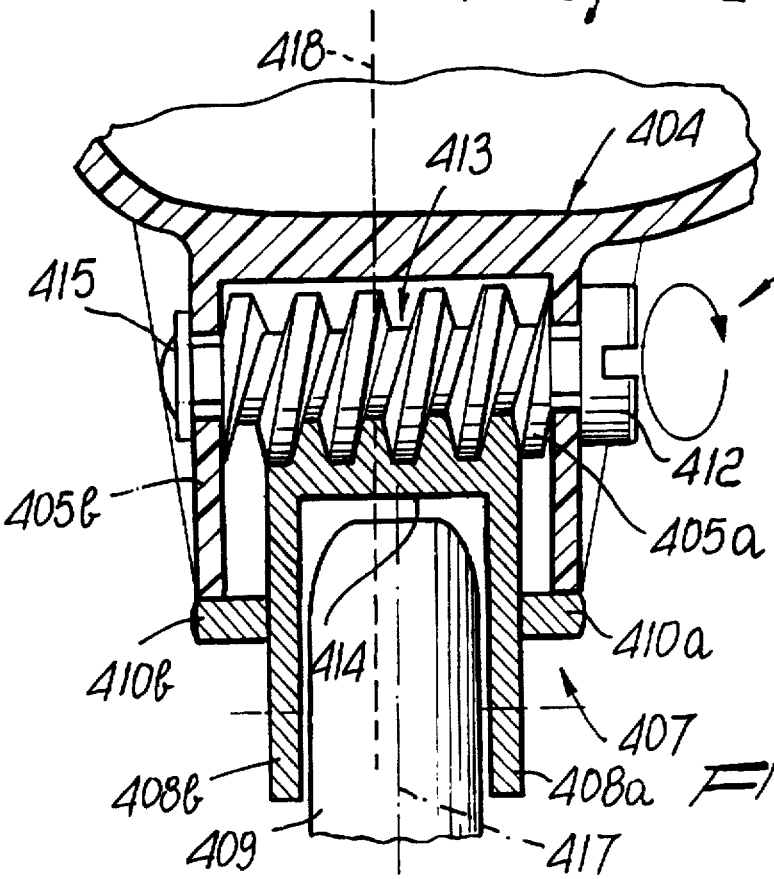
FIG. 10 is a sectional view, taken along the plane X—X of FIG. 9, which passes at the means for allowing the adjustable movement of the support transversely to the frame.
Figure 11:
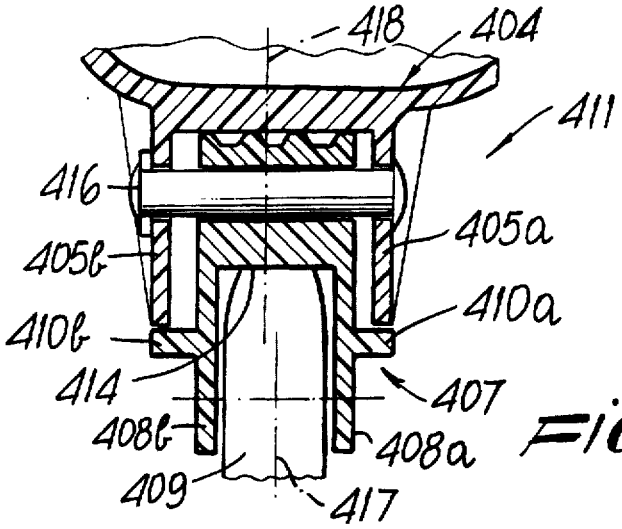
FIG. 11 is a sectional view, taken along the plane XI—XI of FIG. 9.

In FIGS. 9–11, the reference numeral 401 designates a skate which is constituted by at least one quarter 403 associated with a shell 402 and below which an essentially U-shaped frame 404 is associated and forms first wings 405*a* and 405*b* which are directed towards the ground 406.

The skate 401 comprises a support 407 which is also preferably essentially U-shaped and between the second wings 408*a* and 408*b* of which multiple wheels 409 are pivoted and thus mutually aligned.

The shape of the support 407 allows to place it between the first wings 405*a* and 405*b* of the frame 404.

Conveniently, the second wings 408*a* and 408*b* have one or more suitable pairs of raised portions 410*a* and 410*b* or, as an alternative, a single pair of raised portions, which once the support has been inserted abut against the free ends of the first wings 405*a* and 405*b* of the frame 404.

The support 407 interacts with means that can be activated by the user and allow an adjustable movement of the support 407 transversely to said frame 404.

Said means are constituted by at least one worm screw 411 which is arranged below the frame 404 transversely to the first wings 405*a* and 405*b*; said worm screw furthermore has a head 412 which lies outside one of the first wings 405*a* and 405*b* of the frame 404 and a threaded stem 413 which interacts with a complementary thread formed on the facing surface of the base 414 of the support 407 and is freely rotatably associated, at its free end, with a washer 415 that lies outside the other wing of the frame 404.

There are also separate means that can block the support to the frame and are constituted for example by one or more pairs of pins 416 which are arranged transversely and connect the first wings 405*a* and 405*b* of the frame 404 to the base 414 or to the second wings 408*a* and 408*b* of the support 407.

Of course, the pairs of pins are arranged in the interspace between two adjacent wheels or in the interspace between the facing portions of the surface of the base 414 of the support 407 and the rolling surface of the wheel 409.

It is thus possible to vary the mutual position of the longitudinal median axis 417 of the wheels 409 and of the longitudinal median axis 418 of the frame 404, achieving the desired mutual axial offset.

It is thus possible to have a different arrangement of the shoe with respect to the axis that passes through the points where the wheels touch the ground.

Varying the distance between said wheel contact axis and the center of gravity of the user in fact entails advantages according to the sport being practiced: the smaller the distance between said axis that passes through the wheel contact points and the center of gravity of the body, the longer the stroke, considered as the step after the outward thrusting of the skate; accordingly, less frequent thrusts are required, but this entails a slower return of the leg at the end of the stroke to start the subsequent thrust.

Figure 12:
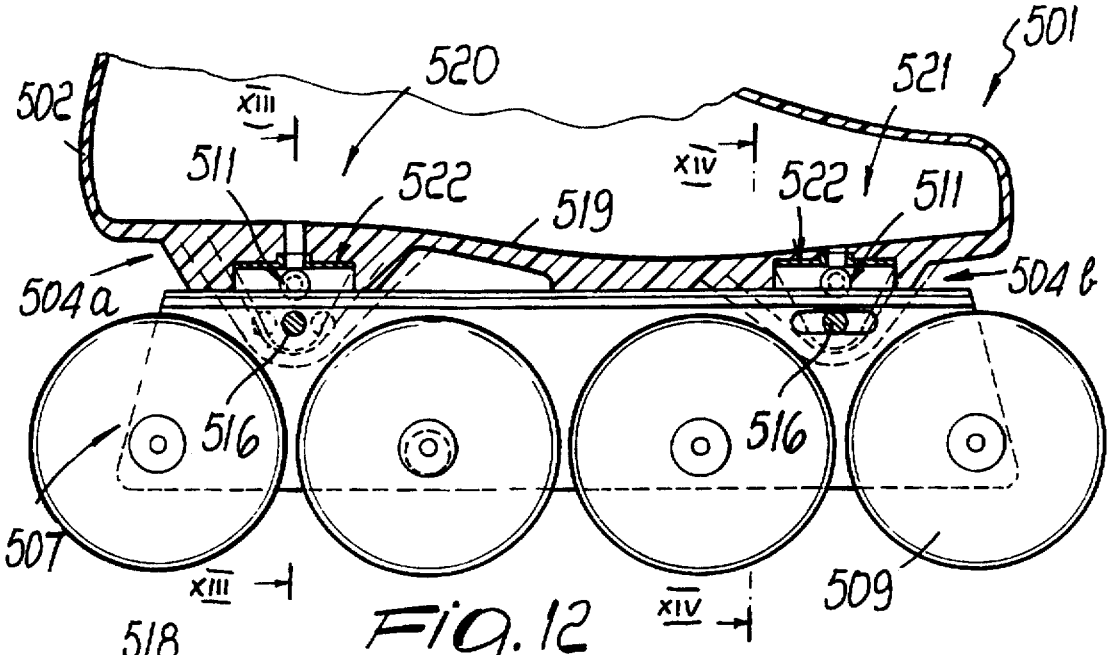
FIG. 12 is a partially sectional side view of a second embodiment.
Figure 13:
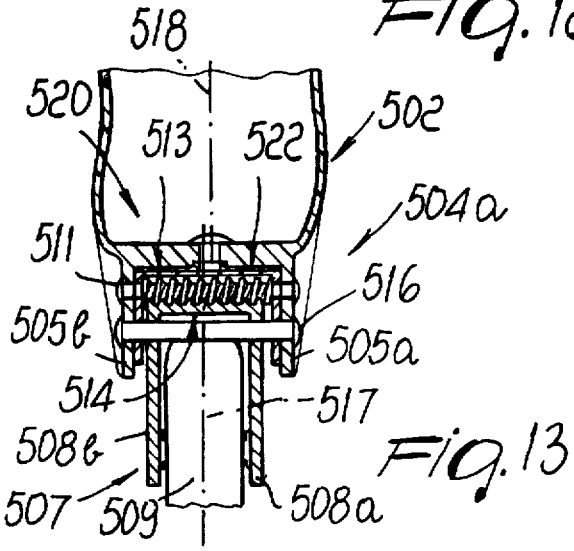
FIG. 13 is a sectional view, taken at the sectional plane XIII—XIII of FIG. 12.
Figure 14:
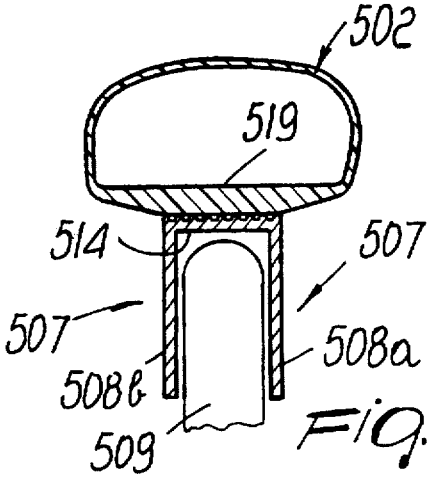
FIG. 14 is a sectional view, taken at the plane XIV—XIV of FIG. 12.

FIGS. 12–14 illustrate another embodiment for a skate 501 which is constituted by a shell 502 in which below the sole 519 there is a frame which is constituted by a first tab 504*a* and by a second tab 504*b* which are essentially U-shaped so as to form, for each tab, first wings 505*a* and 505*b* which are directed towards the ground and located respectively in the heel region 520 and the toe region 521.

The skate 501 comprises a support 507 which is also preferably essentially U-shaped; multiple mutually aligned wheels 509 are pivoted between the second wings 508*a* and 508*b* of said support.

The support 507 again interacts with means which can be activated by the user and allow an adjustable movement of said support 507 transversely to the first and second tabs 504*a* and 504*b* which constitute the frame.

Said means are applied respectively at the first tab and at the second tab and comprise a worm screw 511 which is rotatably associated, at its ends, with the first wings of the first tab and of the second tab, with the optional interposition of a spacer 522 which is again U-shaped and is interposed between said first wings and the second wings of the support 507.

The threaded stem 513 of the worm screw 511 interacts with a complementary thread formed on the facing surface of the base 514 of the support 507.

Separate means are furthermore provided to lock the support 507 to the first wings 505*a* and 505*b* of the first tab 504*a* and of the second tab 504*b*; these separate means include one or more pins 516 arranged transversely to said first wings.

As shown in FIGS. 12 and 13, the axes of the worm screw 511 and of the pins 516 are arranged at a same plane which lies at right angles to the ground.

This solution, too, therefore allows the achievements of the intended aim and objects, as it is possible to achieve a lateral inward or outward movement of the first tab 504*a* and of the second tab 504*b*, along the median longitudinal axis 517 and along the axis of the wheels 509 and with respect to the median longitudinal axis 518.

Figure 15:
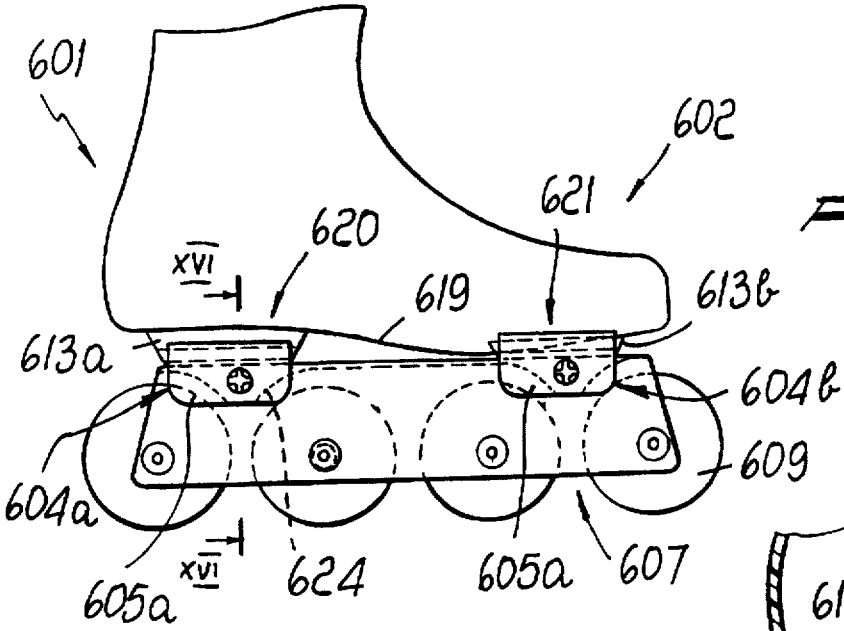
FIG. 15 is a side view of another embodiment.
Figure 16:
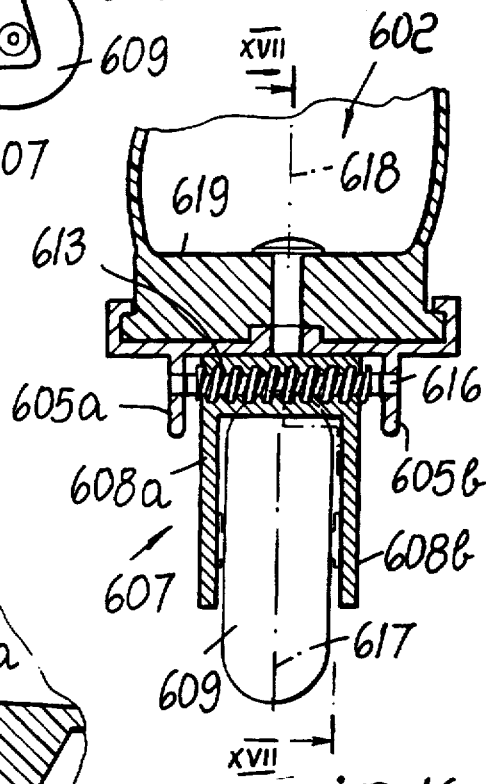
FIG. 16 is a sectional view, taken along the plane XVI—XVI of FIG. 15.
Figure 17:
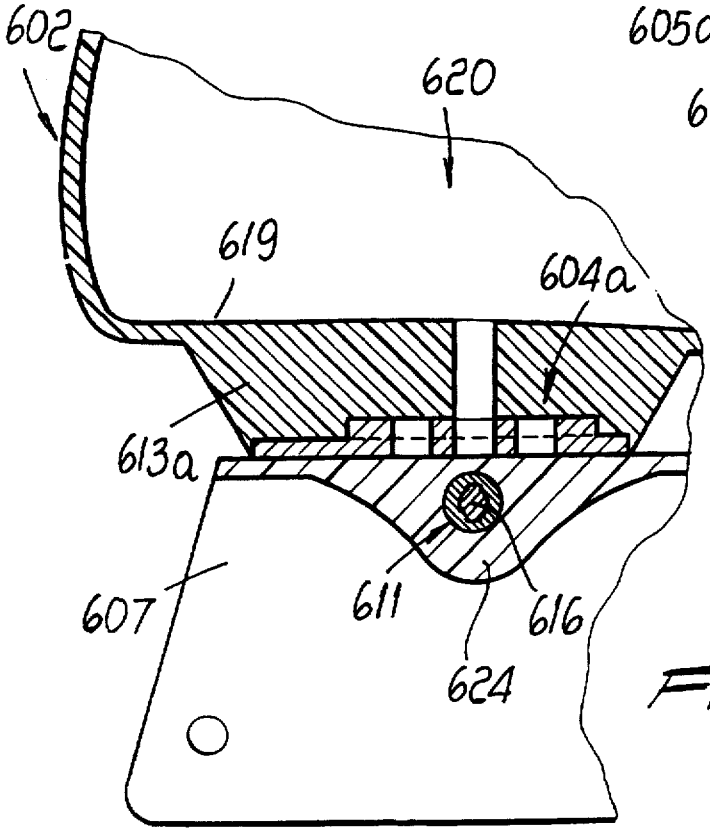
FIG. 17 is a sectional view, taken along the plane XVII—XVII of FIG. 16.

FIGS. 15–17 illustrate another embodiment of a skate 601 which is constituted by a shell 602 which has, below the sole 619, a first stud 613*a* and a second stud 613*b* which protrude at the heel region 620 and at the toe region 621.

A first tab 604*a* and a second tab 604*b* are slidingly associable with the free ends of said first stud and said second stud, which have an essentially T-shaped transverse cross-section. The tabs can be rigidly coupled to the sole 619, and each tab has first wings 605*a* and 605*b* which protrude towards the ground.

The skate 601 is also has a support 607 which is essentially U-shaped and has, at the first tab and at the second tab, a cross-member 624 which is perforated to allow the insertion therein of a pin 616 which interacts, at its ends, with the first wings 605*a* and 605*b* of the first tab and of the second tab.

A worm screw 611 is arranged coaxially to the pin 616 and has a threaded stem 613 which is inserted in a complementary threaded seat formed at the cross-member 624.

The support 607 of course has second wings 608*a* and 608*b* between which one or more mutually aligned wheels 609 are pivoted.

Accordingly, it is possible to vary the mutual position of the longitudinal median axis 617 and the axis of the wheels 609 relative to the longitudinal median axis 618 of the first tab and of the second tab in this case as well.

Of course the materials and the dimensions of the individual components of the skate may vary according to the specific requirements.

What is claimed is:

1. An in-line skate, comprising a frame associated with a support having a plurality of in-line wheels, means being provided for adjusting the position of said support with respect to said frame, wherein said frame is essentially inverted U-shaped so as to form first wings directed towards the ground, said support being also essentially inverted U-shaped and having second wings directed towards the ground, said plurality of wheels being mutually aligned along a longitudinal median axis and being rotatably supported between the second wings of said support, said support being removably insertable between said first wings of said frame along at least one of a direction which is at right angles to a longitudinal median axis of said frame and a direction which is parallel to the longitudinal median axis of said frame, and wherein said second wings have at least one pair of raised portions which abut against free ends of said first wings when said support is inserted between said first wings of said frame, and wherein said second wings have different lateral thicknesses which allow, when said support is removed and reinserted after rotating said support through 180°, to vary the lateral position of the longitudinal median axis of said wheels relative to the longitudinal median axis of said frame.

2. Skate according to claim 1, further comprising guiding and centering means in the form of ridges which protrude from a first base of said support, and complementarily shaped guide recesses formed on a second base of said frame within which said ridges are receivable.

3. An in-line skate, comprising a frame associated with a support having a plurality of in-line wheels, means being provided for adjusting the lateral position of said support with respect of said frame, wherein said frame is essentially inverted U-shaped so as to form first wings directed towards the ground, said support being also essentially inverted U-shaped and having second wings directed towards the ground, said plurality of wheels being mutually aligned and being rotatably supported between the second wings of said support, said support being removably insertable between said first wings of said frame with a longitudinal median axis of said wheels extending parallel to a longitudinal median axis of said frame, and wherein said second wings have different lateral thicknesses which allow, when said support is removed and reinserted after rotating said support through 180°, to vary the lateral position of the longitudinal median axis of said wheels relative to the longitudinal median axis of said frame.

4. Skate according to claim 3, further comprising guiding and centering means in the form of ridges which protrude from a first base of said support, and complementarily shaped guide recesses formed on a second base of said frame within which said ridges are receivable.

5. An in-line skate comprising:

a frame member having a pair of wings, said pair of wings extending in a longitudinal direction and being mutually spaced from one another so as to define a longitudinal space between said pair of wings, said pair of wings having mutually facing inner surfaces which laterally delimit said longitudinal space;

a wheel supporting unit having a first lateral wall portion and a second lateral wall portion, said first and second lateral wall portions being mutually spaced from one another, and said first lateral wall portion having a thickness which is greater than a thickness of said second lateral wall portion;

a plurality of wheels rotatably supported by said wheel supporting unit such that said plurality of wheels are positioned between said first and second lateral wall portions and mutually aligned so as to define a longitudinal median plane of said wheels;

said wheel supporting unit being selectively connectable to said frame member so as to be positioned inside said longitudinal space in one of two selected positions in each of which external lateral surfaces of said first and second lateral wall portions make contact with said mutually facing inner surfaces of said frame member, wherein in a first one of said two selected positions said first lateral wall portion is arranged adjacent a first one of said pair of wings while said second lateral wall portion is arranged adjacent a second one of said pair of wings, and wherein in a second one of said two selected positions said first lateral wall portion is arranged adjacent said second one of said pair of wings while said second lateral wall portion is arranged adjacent said first one of said pair of wings, and wherein said longitudinal median plane of said wheels is arranged nearer the inner surface of said second one of said pair of wings in said first one of said two selected positions than in said second one of said two selected positions.

6. The in-line skate of claim 5 wherein said wheel supporting unit comprises an essentially U-shaped support element having a pair of mutually spaced wings between which said plurality of wheels are rotatably supported.

7. The in-line skate of claim 6 wherein said first lateral wall portion is constituted by a first one of said pair of mutually spaced wings of said support element and wherein said second lateral wall portion is constituted by a second one of said pair of mutually spaced wings of said support element, said first one of said pair of mutually spaced wings of said support element having a thickness which is greater than the thickness of said second one of said pair of mutually spaced wings of said support element.

8. The in-line skate of claim 6 wherein said pair of mutually spaced wings of said support element have an essentially equal thickness, and wherein said wheel supporting unit further comprises an insert element with an increased thickness wall portion forming part of said first lateral wall portion for making said first lateral wall portion thicker than said second lateral wall portion.

* * * * *